US005775251A

United States Patent [19]

Morningstar

[11] Patent Number: 5,775,251

[45] Date of Patent: Jul. 7, 1998

[54] SLIDABLE PEDESTAL RECEIVER FOR BOAT SEAT

[76] Inventor: Craig L. Morningstar, 311 Highland St., Annandale, Minn. 55302

[21] Appl. No.: 714,768

[22] Filed: Sep. 16, 1996

[51] Int. Cl.[6] ..... B63B 17/00

[52] U.S. Cl. ..... 114/363

[58] Field of Search ..... 114/363; 248/415, 248/420; 297/344.1, 311, 353, 241

[56] References Cited

U.S. PATENT DOCUMENTS

| | | | |
|---|---|---|---|
| D. 341,281 | 11/1993 | McIntire . | |
| 4,168,050 | 9/1979 | Nerem et al. | 248/393 |
| 4,352,218 | 10/1982 | Lundberg | 114/363 |
| 4,432,525 | 2/1984 | Duvall | 114/363 |
| 4,766,838 | 8/1988 | Johnson | 114/363 |
| 4,928,620 | 5/1990 | Currey | 114/363 |
| 5,112,103 | 5/1992 | Downer | 297/270 |
| 5,382,082 | 1/1995 | Fatchett | 297/440.22 |
| 5,431,362 | 7/1995 | Carnahan et al. | 248/159 |

*Primary Examiner*—Stephen Avila

*Attorney, Agent, or Firm*—Westman, Champlin & Kelly, P.A.

[57] ABSTRACT

The present invention is a boat seat support. A first track is mounted to the floor, and has a lifted edge spaced above the floor which defines a first channel. A second track is mounted to the floor opposably spaced-apart from the first track, and defines a second channel. A slidable base slides longitudinally within the first and second channels of the first and second tracks. A pedestal receiver attaches to the slidable base and is adapted to receive a support pedestal. A lock is disposed on the slidable base proximate one of the first and second tracks, and is adapted to selectively inhibit slidable movement of the base by engaging one of the tracks. Disengaging the lock allows longitudinal positioning of the boat seat support along the tracks, and engaging the lock fixes the longitudinal position of the boat seat along the tracks.

18 Claims, 5 Drawing Sheets

SLIDABLE PEDESTAL RECEIVER FOR BOAT SEAT

BACKGROUND OF THE INVENTION

The present invention relates to boat seats. More specifically, it relates to an adjustable boat seat base.

Boating includes many types of recreation including, among other things, water skiing, fishing and sight-seeing. A vast majority of the time pent in a boat is spent sitting. Additionally, sitting in a boat is safer than standing because a sitting boater's center of gravity is lower than that of a standing boater and hence more stable. In addition, some of the activities for which boats are used require the boater to operate different motors or assume different positions in the boat. To ensure comfort, and promote safety, a boat seat needs to accommodate the myriad different types of boaters and uses.

This accommodation is accomplished to some degree by conventional boat seats which allow a boater to pivot, and adjust up and down positions of the seat. However, the conventional boat seat is limited because it attaches to a single point on the boat floor. While this type of seat has utility, it fails to adequately accommodate boaters of different size. Furthermore, the traditional seats allow only one fixed floor location for all of the possible uses to which a boat may be put.

SUMMARY OF THE INVENTION

The present invention surmounts the limits of the prior art by providing an adjustable seat base which allows forward and backward positioning. The seat base allows different positions for different boaters/uses thereby increasing comfort. The mechanism is simple and easy to operate providing economical assembly. Further, the seat base, pedestal and lock can be built with a low profile to occupy minimum space when not supporting a seat.

Specifically, the present invention includes a boat seat support. A first track is mounted to the floor of the boat, and has a lifted edge spaced above the floor which defines a first channel. A second track is mounted to the floor opposably spaced-apart from the first track, and defines a second channel. A slidable base slides longitudinally within the first and second channels of the first and second tracks. A pedestal receiver attaches to the slidable base and is adapted to receive a support pedestal. A lock is disposed on the slidable base proximate one of the first and second tracks, and is adapted to selectively inhibit slidable movement of the base by engaging one of the tracks. Disengaging the lock allows longitudinal postioning of the boat seat support along the tracks, and engaging the lock fixes the longitudinal position of the boat seat along the tracks.

DETAILED DESCRIPTION OF THE PREFERRED EMBODIMENTS

Figure 1:
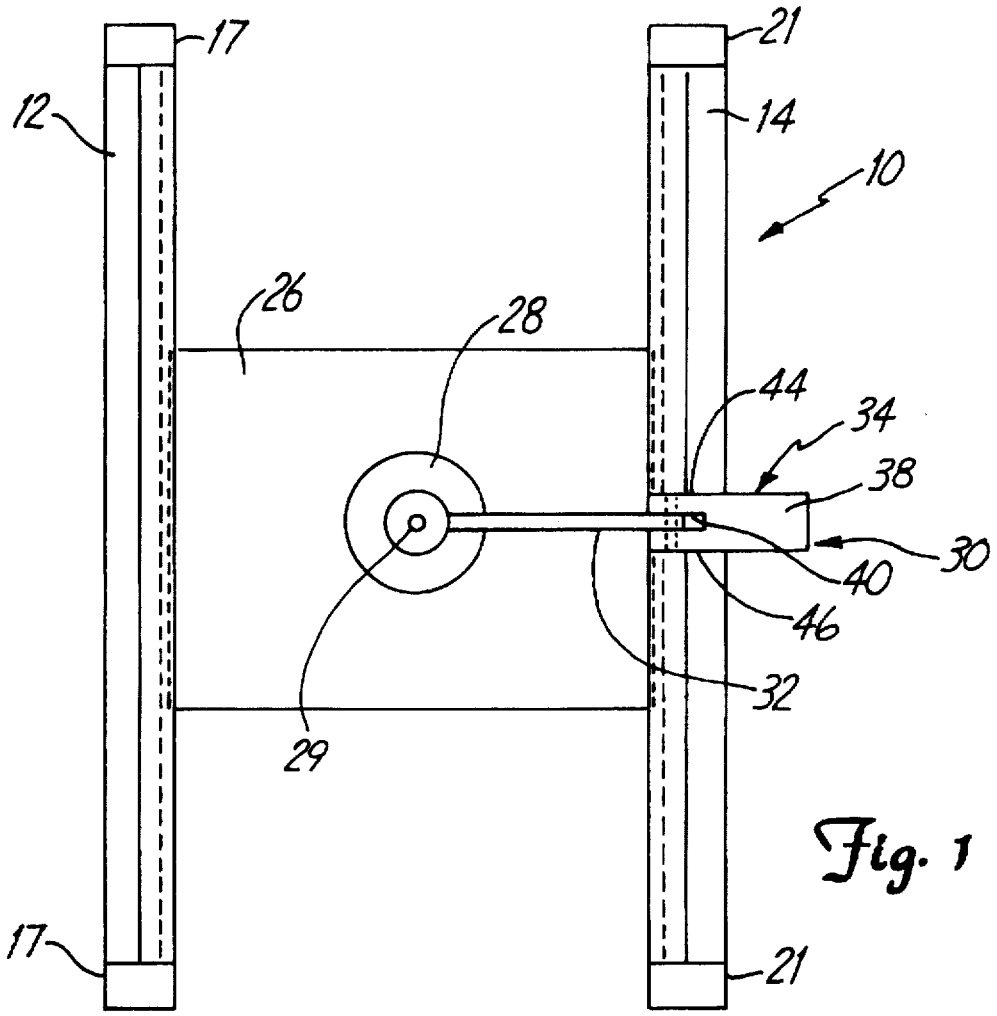
FIG. 1 is a top plan view of the slidable seat base of the present invention.
Figure 2:
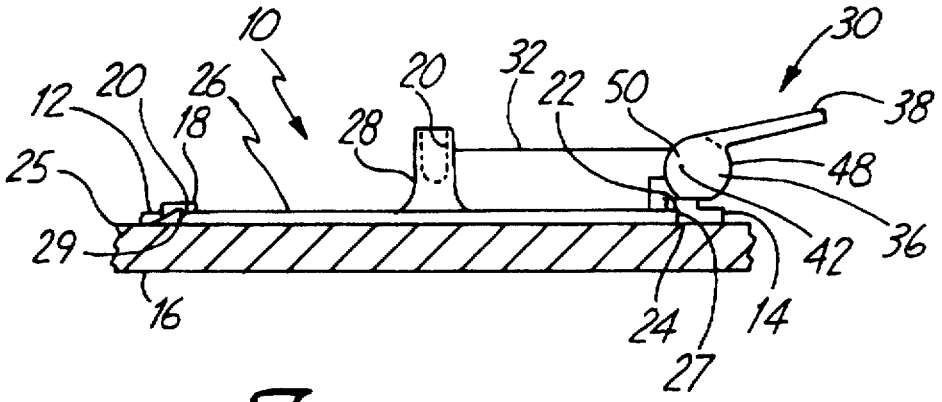
FIG. 2 is a front elevation view of the slidable seat base of the present invention.

FIGS. 1 and 2 are top plan and partial sectional elevation views, respectively, of slidable pedestal seat base 10 in accordance with the present invention. Seat base 10 includes first track 12, second track 14, slidable base 26, pedestal receiver 28, and lock 30.

First track 12 and second track 14 are opposably spaced-apart from one another. First track 12 is mounted to floor 16 by means of one of rivets, screws, and spot welds. First track 12 includes end stops 17 disposed on both ends of first track 12, and lifted portion 18 which is spaced above the floor to define channel 20. Second track 14 is mounted to floor 16 by means of one of rivets, screws, and spot welds. Second track 14 includes end stops 21 disposed on both ends of second track 14, and lifted portion 22 which is spaced above floor 16 to define channel 24. Slidable base 26 has lateral edges 25 and 27 which are slidably captured within channels 24 and 20, respectively. Edges 25 and 27 of base 26 are sized to fit with small clearance in channels 24 and 20. Thus, bases 26 slides smoothly in a longitudinal direction between first track 12 and second track 14 in channels 24 and 20.

Pedestal receiver 28 is disposed on slidable base 26, and includes bore 29. Preferably, pedestal receiver 28, and slidable base 26 are aluminum, stainless steel, steel, plastic or galvanized steel, and are integrally formed with a height, in the area where an occupant's feet typically reside of one inch or less. Pedestal receiver 28 is adapted to receive conventional boat seat pedestal 54 (shown in FIG. 3). This is described in greater detail with respect to FIG. 3.

Lock 30 is adapted to selectably inhibit slidable longitudinal movement of base 26 relative to tracks 12 and 14, and includes bracket 32, and friction member 34. Preferably, the height of lock 30 is two inches or less. Bracket 32 is attached to pedestal 28 and slidable base 26, and extends over second track 14. Friction member 34 comprises cam portion 36, lever portion 38, slot 40 and mounting hole 42. Cam portion 36 includes first sidewall 44, second sidewall 46 opposed to first sidewall 44, and circumferential sidewall 48 to which lever 40 is tangentially attached. Mounting hole 42 extends from first sidewall 44 to second sidewall 46, and is disposed eccentric of cam portion 36. Slot 40 extends from circumferential sidewall 48 to a location further distant from mounting hole 42.

Friction member 34 is rotatably attached to bracket 32 by hinge pin 50 with bracket 32 disposed within slot 40. Lever 38 is aligned with friction member 34 such that applying a force to lever 38 produces a corresponding moment on cam portion 36 about pin 50. Because mounting hole 42 is disposed eccentric of cam portion 36, circumferential side wall 48 is caused to frictionally engage second track 14 thereby inhibiting longitudinal movement of base 26.

Figure 3:
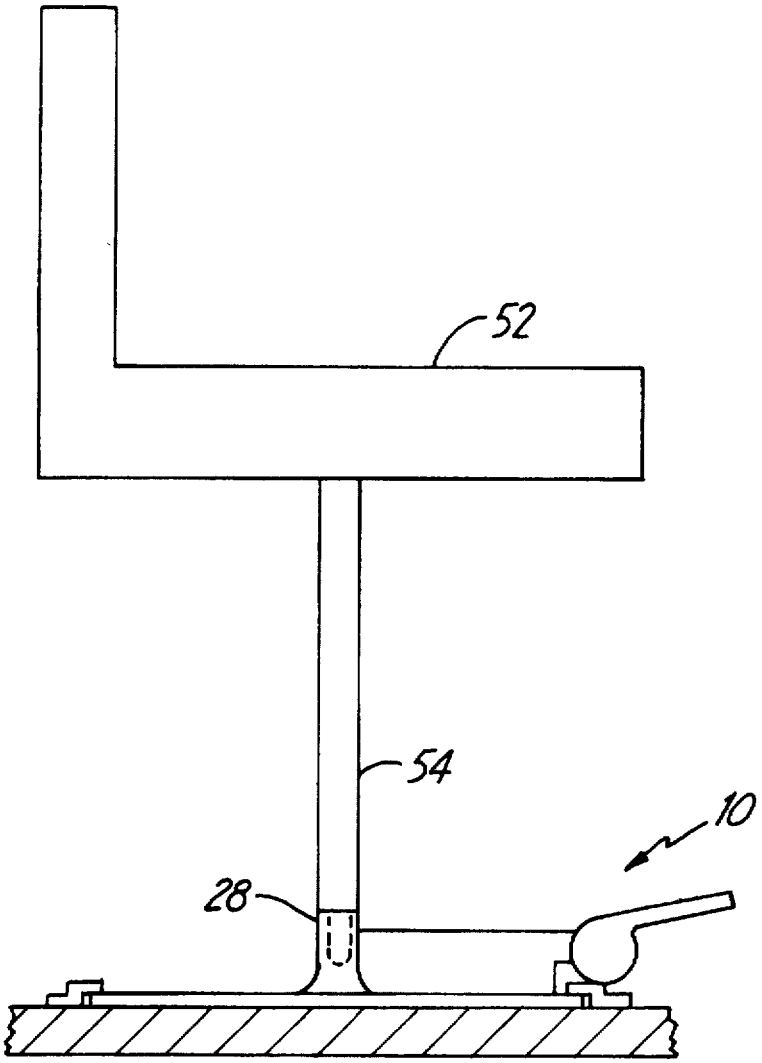
FIG. 3 is a side elevation view of the slidable seat base according to the present invention holding a conventional boat seat.

FIG. 3 is a side elevation view of adjustable seat base 10 supporting a conventional boat seat 52. Seat pedestal 54 couples to pedestal receiver 28, and supports seat 52. Seat pedestal 54 and boat seat 52 may be (for example) of a design similar to that disclosed in U.S. Pat. No. 4,928,620 to Currey.

Figure 4:
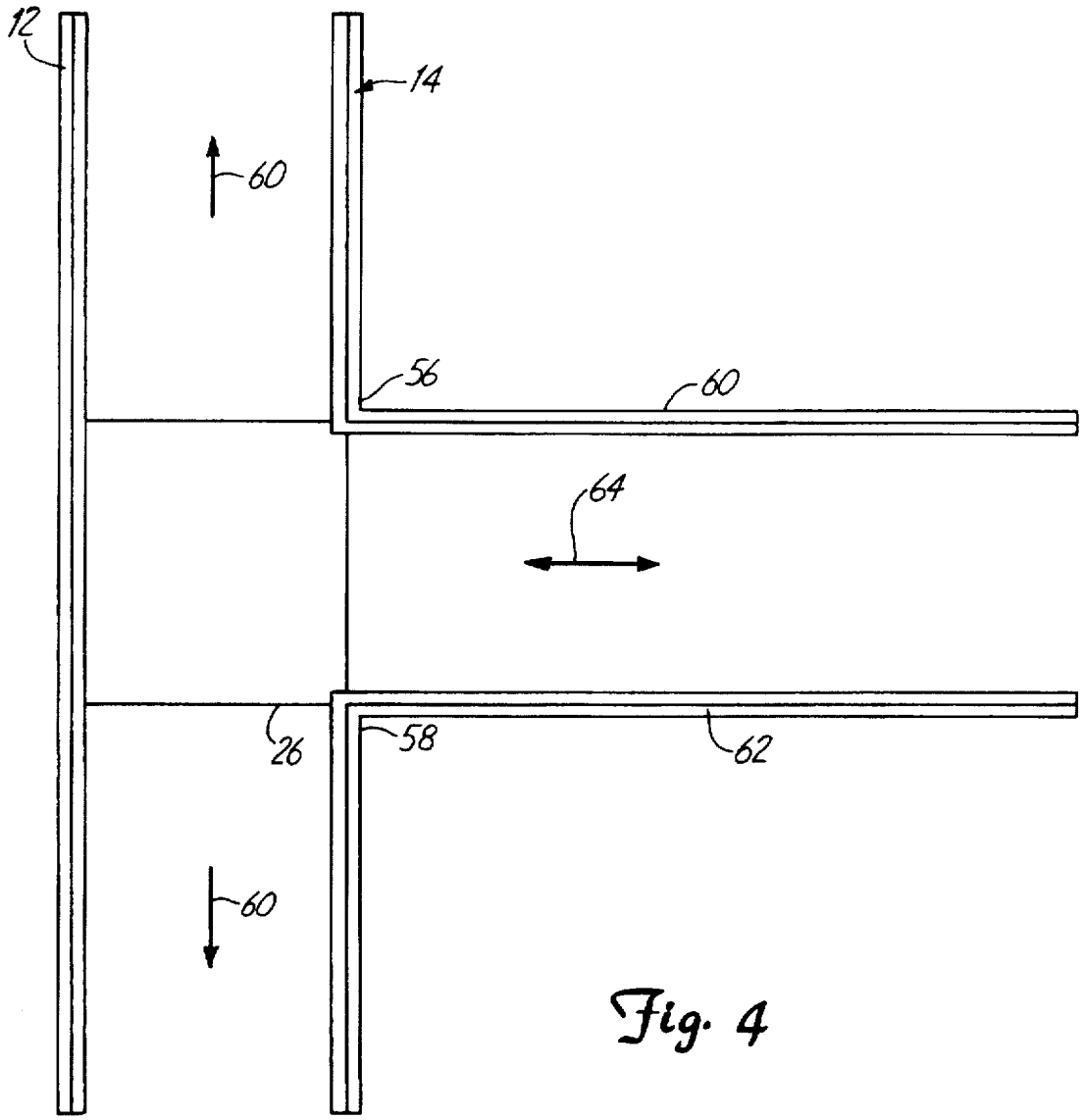
FIG. 4 is a top plan view of a portion of an alternative embodiment of the present invention.

FIG. 4 is a top plan view of tracks in an alternative embodiment of the present invention. First track 12 remains unchanged in the alternative embodiment. Second track 14 however, includes a break between first end 56 and second end 58. Third track 60 is disposed transverse to second track 14, and is coupled to the first end 56 through a mitered corner. Fourth track 62 is disposed transverse to second track 14, and is coupled to second end 58 through a mitered corner. In the alternative embodiment, slidable base 26 is able to move in all directions indicated by arrows 60 and 64.

Figure 5:
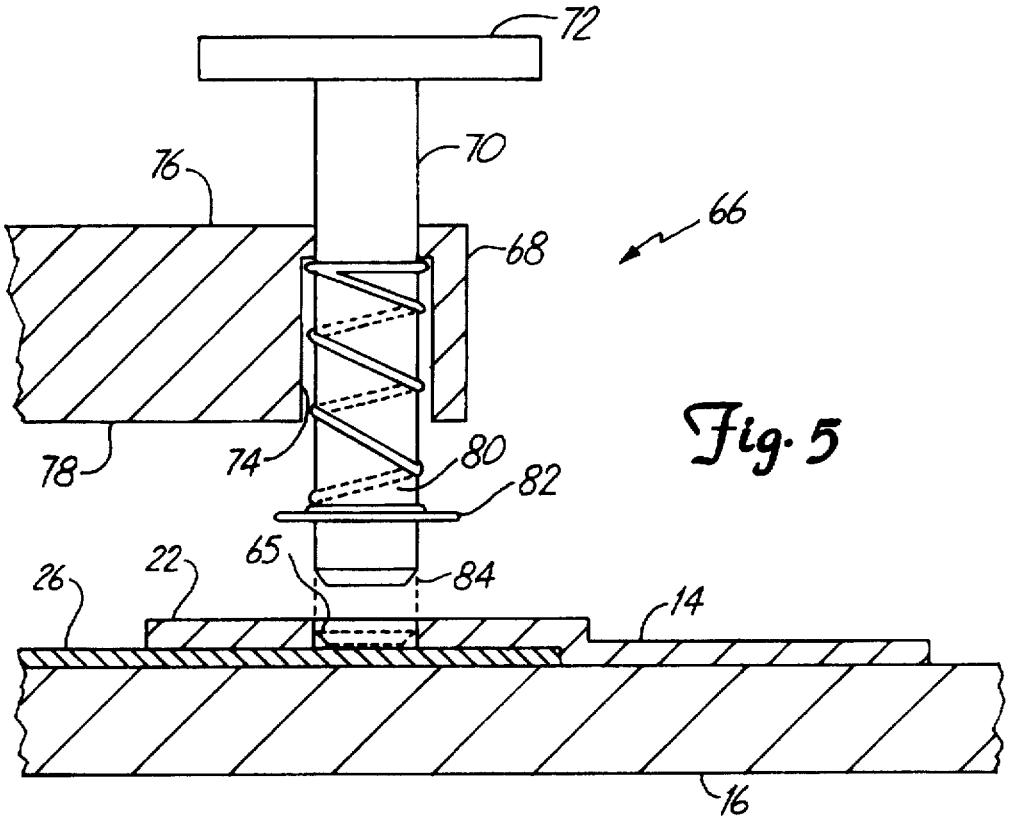
FIG. 5 is a cross-sectional side elevation view of a lock in accordance with an alternative embodiment of the present invention.

FIG. 5 is a cross-sectional elevation view of a lock in accordance with an alternative Embodiment. The alternative embodiment is identical to the preferred embodiment with the following exceptions: second track 14 further comprises vertical through holes 65 disposed within lifted portion 22 along second track 14; and lock 30 is replaced with lock 66. Lock 66 includes bracket 68, lock pin 70, and handle 72. Bracket 68 extends over second track 14, and is attached to base 26 and pedestal 28 (shown in FIG. 1). Bracket 68 comprises vertical hole 74 which extends from top surface 76 to bottom surface 78. Hole 74 has a diameter near top surface 76 large enough to allow clearance for lock pin 70, and a larger diameter near bottom surface 78 large enough to allow clearance for lock pin 70 and compression spring 80 disposed coextensively about lock pin 70. Lock pin 70 includes handle 72, spring stop 82, arid tapered portion 84 disposed on the bottom of lock pin 70. Lock pin 70 is slidably disposed within hole 74. Compression spring 80 is disposed coextensively about the lower portion of lock pin 70. Stop 82 is fixed coextensively about lock pin 70 near tapered portion 84 such that compression spring 80 is captured between bracket 68 and stop 82 thereby urging lock pin 70 downward. When lock pin 70 is in its down position, as shown in phantom in FIG. 5, longitudinal movement of base 26 is inhibited.

Figure 6:
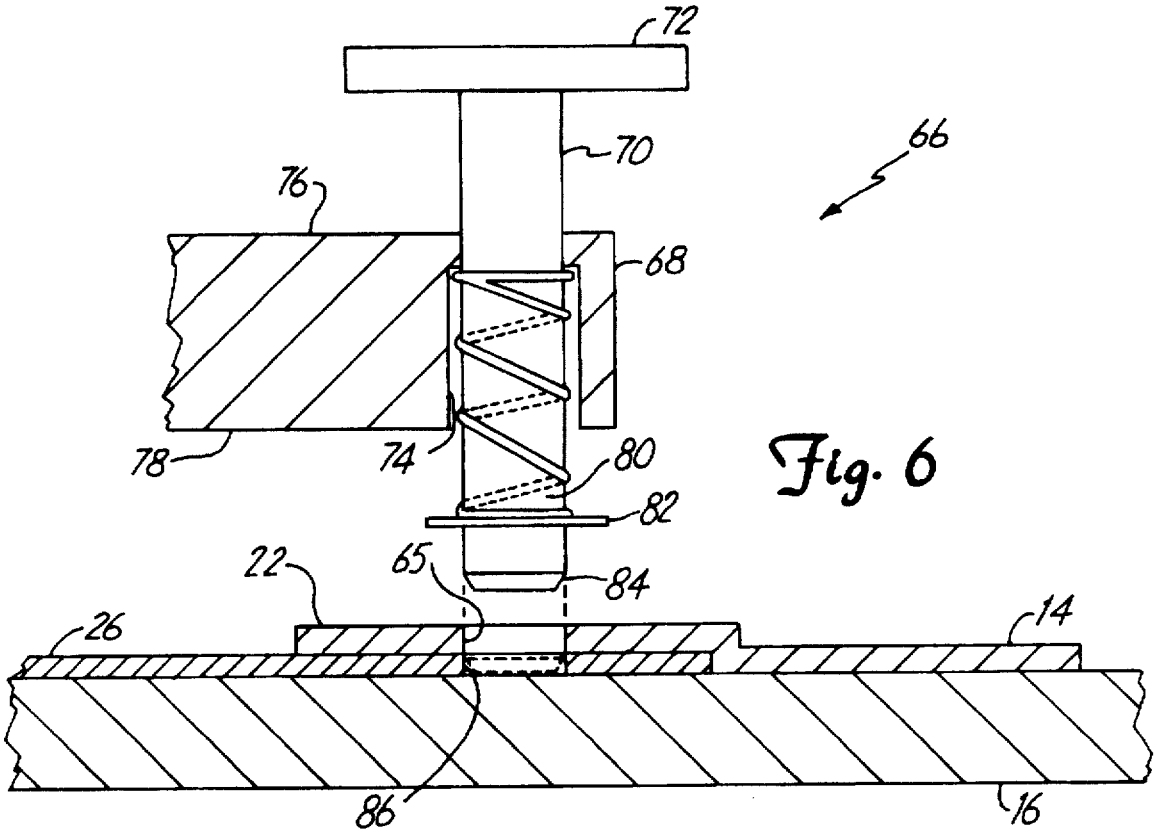
FIG. 6 is a cross-sectional side elevation view of the lock shown in FIG. 5, with an optional modification.

FIG. 6 is a cross-sectional side elevation view of lock 66 as shown in FIG. 5 with a slight modification. FIG. 6 shows base hole 86 extending through slidable base 26, and disposed directly beneath lock pin 70. Allowing lock pin 70 to engage slidable base 26 via hole 86 (shown in phantom in FIG. 6) provides increased holding power to lock 66.

Figure 7:
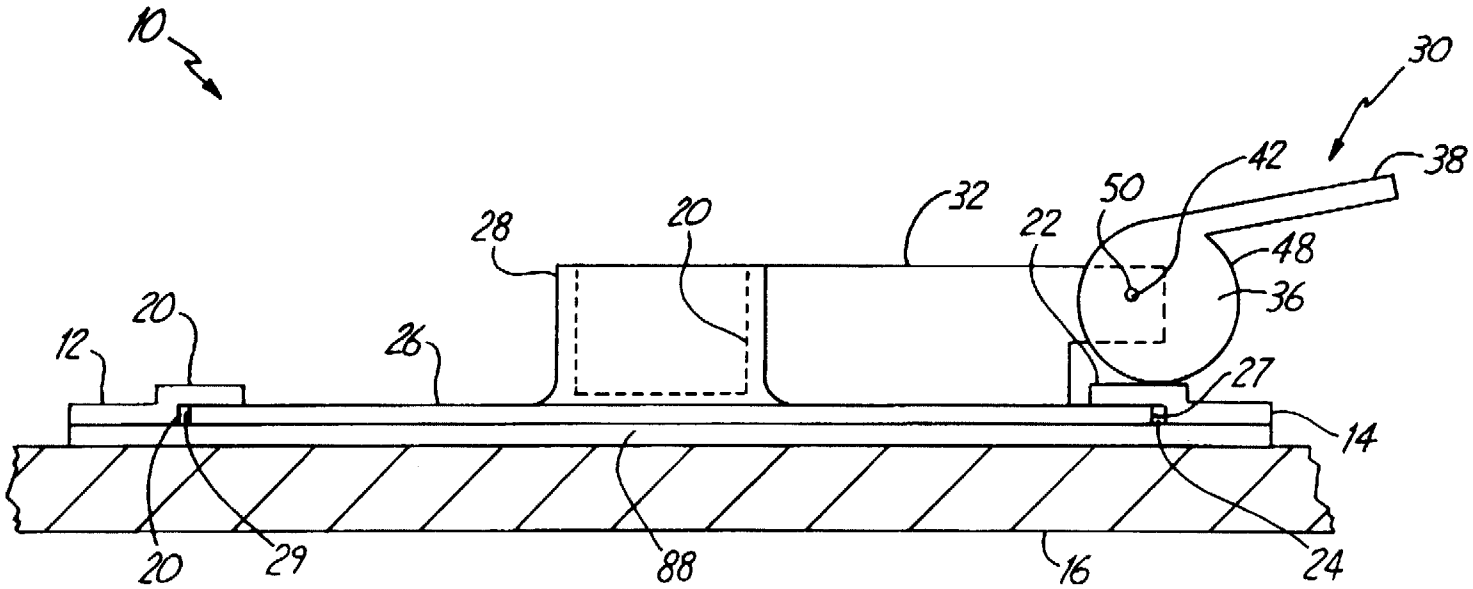
FIG. 7 is a front elevation view of the slidable boat seat base of the present invention as shown in FIG. 2, adapted to allow the slidable boat seat to be used on boat floors with any sort of floor covering including but not limited to indoor/outdoor carpeting.

FIG. 7 is a front elevation view of the slidable boat seat base of the present invention as shown in FIG. 2, adapted to allow the slidable boat seat to be used on boat floors with any sort of floor covering including but not limited to indoor/outdoor carpeting. Floor plate 88 is interposed between floor 16 and tracks 12, 14. Slidable base 26 smoothly slides longitudinally between first track 12 and second track 14, over floor plate 88. Floor plate 88 is preferably metal, and provides a lower coefficient of friction for slidable base 26 than floor 16. Additionally, floor plate 88 aids in containing lubricants such as grease within channels 20, 24.

Although the present invention has been described with reference to preferred embodiments, workers skilled in the art will recognize that changes may be made in form and detail without departing from the spirit and scope of the invention.

What is claimed is:

1. A boat seat support for use in a boat having a floor, the boat seat support comprising:

a first track mounted to the floor having a lifted edge spaced above the floor and defining a first channel;

a second track mounted to the floor opposably spaced-apart from the first track and defining a second channel;

a slidable base slidable longitudinally within the first and second channels of the first and second tracks;

a pedestal receiver attached to the slidable base and adapted to receive a support pedestal;

a lock disposed on the slidable base proximate one of the first and second tracks, and adapted to selectively inhibit slidable movement of the base by engaging one of the tracks; and wherein disengaging the lock allows longitudinal positioning of the boat seat support along the tracks, and engaging the lock fixes the longitudinal position of the boat seat along the tracks.

2. The boat seat support of claim 1 wherein the height of the slidable base, and the first and second tracks does not exceed one inch.

3. The boat seat support of claim 1 wherein the first and second tracks, slidable base, and pedestal receiver are constructed from one of aluminum and galvanized steel, stainless steel, steel, or plastic.

4. The boat seat support of claim 1 wherein the first and second tracks are mounted to the floor by means of one of screws, rivets, and spot welds.

5. The boat seat support of claim 1 wherein the first and second tracks further comprise stops mounted at opposite ends of each track.

6. The boat seat support of claim 1 wherein the pedestal receiver and the slidable base are cast as one piece.

7. The boat seat support of claim 1 wherein the slidable base is shaped as a rectangle.

8. The boat seat support of claim 7 wherein the lock further comprises:

a bracket attached to the base and the pedestal receiver, having a cam engaging end extending over one of the tracks;

a cam having a first sidewall, second sidewall opposed to the first sidewall, a circumferential sidewall to which a lever is tangentially attached, and an eccentric mounting hole extending from the first sidewall to the second sidewall, and a slot extending from a circumferential sidewall to a location further distant from the eccentric mounting wall;

a mounting pin rotatably attaching the cam to the bracket such that the cam engaging end of the bracket is disposed within the slot;

a lever tangentially attached to the circumferential sidewall of the cam;

wherein applying an engaging force to the lever drives the cam into frictional engagement with one of the tracks, and reversing the force lifts the cams and removes the frictional engagement.

9. The boat seat support of claim 1 wherein the lock further comprises:

a bracket attached to the base and the pedestal receiver, the bracket having an engaging end extending over one of the tracks, the engaging end including a vertical hole extending therethrough;

a lock pin slidably disposed within the vertical hole, and extending therefrom;

a spring coupled to the engaging end, and the lock pin, and biasing the lock pin downwardly; and catch holes for receiving the lock pin, the catch holes disposed along the track which is disposed under the engaging end.

10. A boat seat of claim 9 wherein the base further comprises:

a base hole disposed directly under the lock pin for receiving the lock pin.

11. An adjustable boat seat for use in a boat having a floor, the boat seat comprising:

a first track mounted to the floor, having a lifted edge spaced above the floor defining a first channel;

a second track mounted to the floor opposably spaced-apart from the first track and having a lifted edge defining a second channel;

a slidable base sliding longitudinally within the channels of the first and second tracks;

a pedestal receiver attached to the slidable base and adapted to receive a support pedestal;

a lock disposed on the slidable base proximate one of the first and second tracks, and adapted to selectively fix slidable movement of the base by engaging one of the tracks;

a support pedestal rotatably mounted to the pedestal receiver; and a seat mounted to the support pedestal.

12. The adjustable boat seat of claim 11 wherein the height of the slidable base, and the first and second tracks does not exceed one inch.

13. The adjustable boat seat of claim 11 wherein the first and second tracks, slidable base, and pedestal receiver are constructed from one of aluminum and galvanized steel, stainless steel, steel, or plastic.

14. The adjustable boat seat of claim 11 wherein the first and second tracks are mounted to the floor by means of one of screws, rivets, and spot welds.

15. The adjustable boat seat of claim 11 wherein the first and second tracks further comprise stops mounted at both ends of each track.

16. The adjustable boat seat of claim 11 wherein the pedestal receiver and the slidable base are cast as one piece.

17. The adjustable boat seat of claim 11 wherein the slidable base is shaped as a rectangle.

18. The adjustable boat seat of claim 11 wherein the second track further comprises:

a gap having a first end and second end and of sufficient length to allow the slidable base to pass;

a third track coupled to the first end and extending transversely therefrom;

a fourth track coupled to the second end and extending transversely therefrom.

* * * * *